US007140910B1

(12) United States Patent
Liao

(10) Patent No.: US 7,140,910 B1
(45) Date of Patent: Nov. 28, 2006

(54) ADJUSTABLE CONNECTION ASSEMBLY

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/177,374

(22) Filed: Jul. 11, 2005

(30) Foreign Application Priority Data

May 10, 2005 (TW) ..... 94207509 U

(51) Int. Cl.
*H01R 11/00* (2006.01)

(52) U.S. Cl. ..... 439/502; 439/660; 439/607; 439/501

(58) Field of Classification Search ..... 439/502–506, 439/660, 607, 501
See application file for complete search history.

(56) References Cited

U.S. PATENT DOCUMENTS 3,538,484 A * 11/1970 Fassafiume ..... 439/357
4,109,193 A * 8/1978 Schultheis ..... 320/109
4,648,682 A * 3/1987 Tubbs ..... 439/391
5,816,848 A * 10/1998 Zimmerman ..... 439/502
6,283,789 B1 * 9/2001 Tsai ..... 439/502
6,746,273 B1 * 6/2004 Liu et al. ..... 439/502
6,902,428 B1 * 6/2005 Wong ..... 439/528
6,979,223 B1 * 12/2005 Chen ..... 439/490
7,004,787 B1 * 2/2006 Milan ..... 439/502
2003/0068921 A1 * 4/2003 Hung et al. ..... 439/502
2003/0207611 A1 * 11/2003 Lin et al. ..... 439/501
2005/0070153 A1 * 3/2005 Tang ..... 439/502
2005/0070154 A1 * 3/2005 Milan ..... 439/502
2005/0215110 A1 * 9/2005 Chen ..... 439/502
2006/0025008 A1 * 2/2006 Beck et al. ..... 439/502

* cited by examiner

*Primary Examiner*—Gary F. Paumen
(74) *Attorney, Agent, or Firm*—Rosenberg, Klein & Lee

(57) ABSTRACT

The present invention describes an adjustable connection assembly. The adjustable connection assembly has a first connector, a second connector and a signals cable. The first connector has a first isolation main body and a plurality of first terminals, and the first terminals are positioned at the first isolation main body. The second connector has a second isolation main body and a plurality of second terminals, and the second terminals are positioned at the second isolation main body. The signal cable is positioned between the first connector and the second connector. Besides, the signal cable includes a plurality of conductive wires, and both ends of the conductive wires are electrically connected with the first connector and the second connector, respectively. The signal cable is helical-shaped, flexible and retractable.

7 Claims, 6 Drawing Sheets

ADJUSTABLE CONNECTION ASSEMBLY

BACKGROUND OF THE INVENTION

1. Field of the Invention

The present invention relates to an adjustable connection assembly, and in particular to an adjustable connector with good adaptability.

2. Description of Related Art

When conventional signal cables are electrically connected to electronic devices, a plug positioned at one end of the conventional signal cable is plugged into a corresponding connector. Thus, the electronic devices are electrically connected to the cable signals because the plug and the corresponding connector are electrically connected. However, if the type of the plug of the conventional signal cable is different from that of the electronic device, then there is a need for a converter. The conventional converter cannot be adjustable (change in length or angle), so it is rather difficult to connect corresponding plugs and connectors. It is inconvenient and lacks adaptability.

SUMMARY OF THE INVENTION

It is an object of the present invention to provide an adjustable connection assembly. Orientation and length of the adjustable connection assembly can be adjusted to meet practical demands.

In order to accomplish the object of the present invention, the present invention provides an adjustable connection assembly. The adjustable connection assembly includes a first connector, a second connector and a signal cable. The first connector includes a first isolation main body and a plurality of first terminals, and the first terminals are positioned at the first isolation main body. The second connector includes a second isolation main body and a plurality of second terminals, and the second terminals are positioned at the second isolation main body. The signal cable is positioned between the first connector and the second connector. Besides, the signal cable includes a plurality of conductive wires, and both ends of the conductive wires are electrically connected with the first connector and the second connector respectively. The signal cable is helical-shaped, flexible and retractable.

According to the present invention, the first connector is electrically connected with the second connector by the signal cable that is helical-shaped, flexible and retractable. The first connector is positioned at any angle to the second connector so that it is convenient for the first connector and the second connector to plug into corresponding connectors. The present invention has excellent adaptability.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, and is made merely for the purpose of illustrating general principles of embodiments of the invention. The scope of the invention is best defined by the appended claims.

Figure 1:
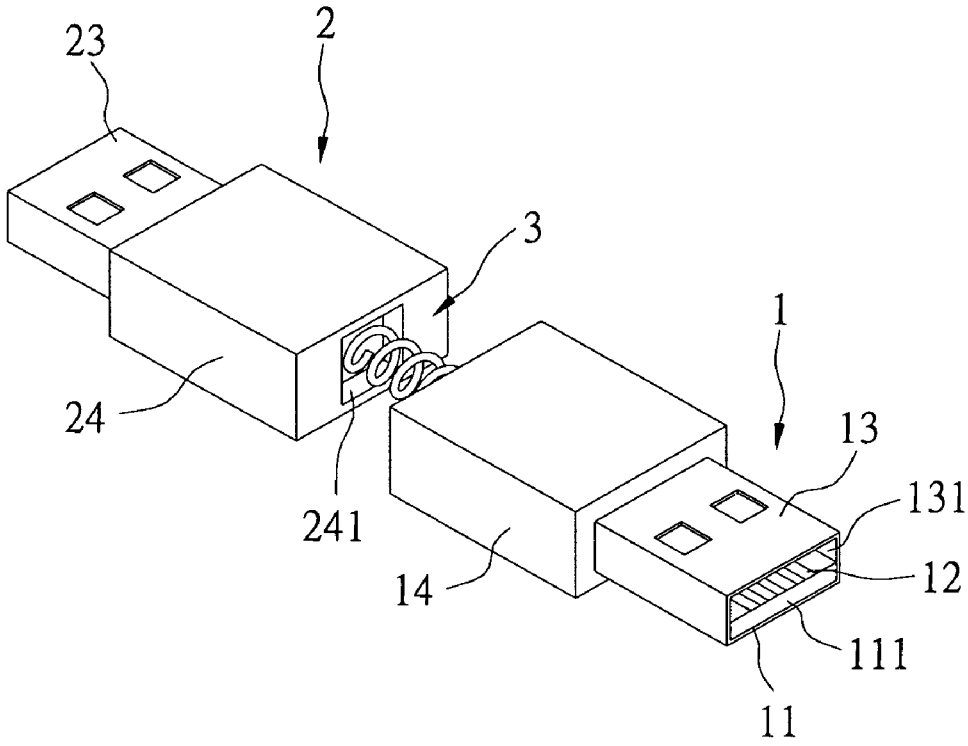
FIG. 1 illustrates a perspective view of an adjustable connection assembly according to the first embodiment of the present invention.
Figure 2:
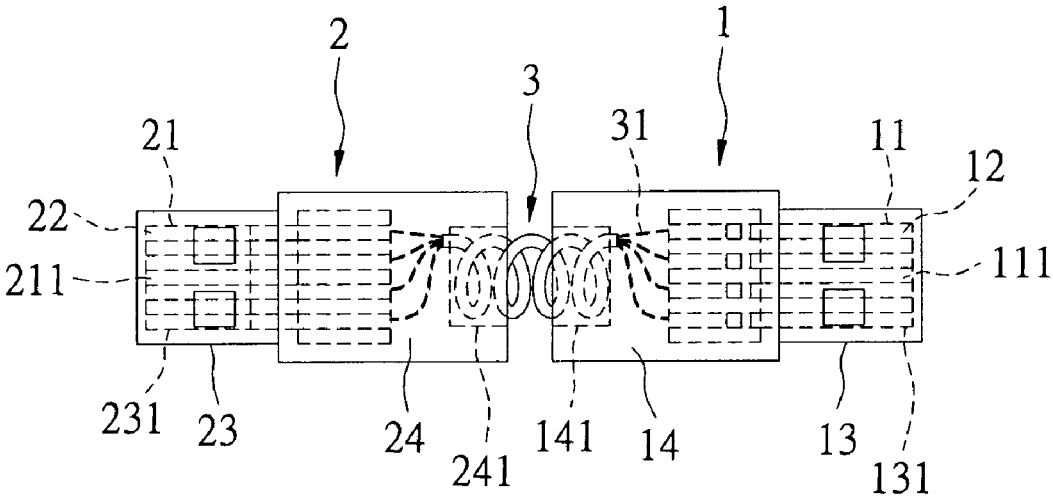
FIG. 2 illustrates a top elevational view of the adjustable connection assembly of FIG. 1.

Reference is made to FIGS. 1 and 2. The present invention provides an adjustable connection assembly. According to the present invention, the adjustable connection assembly includes a first connector 1, a second connector 2 and a signals cable 3. The first connector 1 may be a plug, a socket or other electrical connectors (such as USB port or IEEE 1394 interface). The first connector 1 includes a first isolation main body 11, a plurality of first terminals 12 and a first shielding housing 13. The first isolation main body 11 is made of plastic and has a protruding portion 111.

The first terminals 12 are made of metallic material with good conductivity and positioned at the first isolation main body 11. One end of the first terminals 12 extends to the protruding portion 111 of the first isolation main body 11. When the first connector 1 is plugged into a corresponding connector, each first terminal 12 is in electrical contact with a corresponding terminal of the corresponding connector.

The first shielding housing 13 is made of metallic material with good shielding and is box-shaped. The first shielding housing 13 encloses the protruding portion 111 of the first isolation main body 11 and includes an opening 131 at one end. The opening 131 is defined by the protruding portion 111 of the first isolation main body 11 and used to receive a corresponding connector.

A first housing 14 is manufactured by injection-modeling and is electrically isolated. Additionally, the first housing 14 is used to enclose the first isolation main body 11, the first terminals 12 and the first shielding housing 13. A first recess 141 is positioned at a rear end of the first housing 14 and used to receive the signal cable 3.

The second connector 2 may be a plug, a socket or other electrical connectors (such as USB port or IEEE 1394 interface). The second connector 2 includes a second isolation main body 21, a plurality of second terminals 22 and a second shielding housing 23. The second isolation main body 21 is made of plastic and has a protruding portion 211.

The second terminals 22 are made of metallic material with good conductivity and positioned at the second isolation main body 21. One end of the second terminals 22 extends to the protruding portion 211 of the second isolation main body 21. When the second connector 2 is plugged into a corresponding connection port, each second terminal 22 is in electrical contact with corresponding terminal of the corresponding connection port.

The second shielding housing 23 is made of metallic material with good shielding and is box-shaped. The second shielding housing 23 encloses the protruding portion 211 of the second isolation main body 21 and includes an opening 231 at one end. The opening 231 is defined by the protruding portion 211 of the second shielding housing 23 and used to receive a corresponding connection port.

Figure 7:
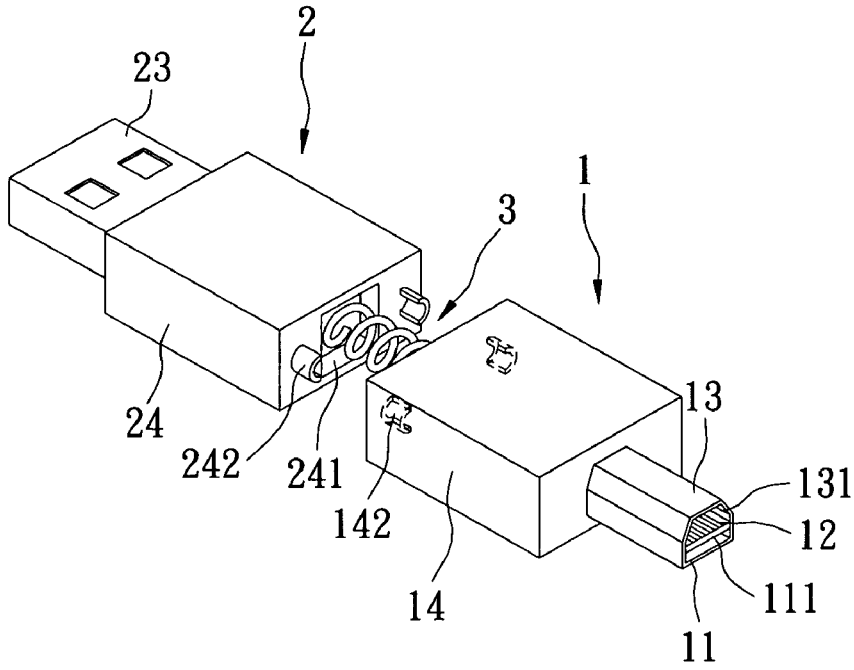
FIG. 7 illustrates a perspective view of an adjustable connection assembly according to the sixth embodiment of the present invention.

A second housing 24 is manufactured by injection modeling process and is electrically isolated. Additionally, the second housing 24 is used to enclose the second isolation main body 21, the second terminals 22 and the second shielding housing 23. A second recess 241 is positioned at a rear end of the second housing 24 and used to receive the signal cable 3. The first connector 1 and the second connector 2 may be the same type of connectors or different types of connectors, as shown in FIG. 7.

The signal cable 3 is positioned between the first connector 1 and the second connector 2. Besides, the signal cable 3 includes a plurality of conductive wires 31, and both ends of the conductive wires 31 are electrically connected with the first connector 12 and the second connector 22, respectively. The signal cable 3 is helical-shaped, flexible and retractable so that orientation and length between the first connector 12 and second connector 22 are adjustable.

According to the present invention, the first connector 1 is electrically connected with the second connector 2 by the signal cable 3. Because the signal cable 3 is flexible and helical, orientation and length between the first connector 12 and second connector 22 are adjustable. It is convenient to plug in corresponding connectors (plug or socket) and the present invention has good adaptability.

Figure 3:
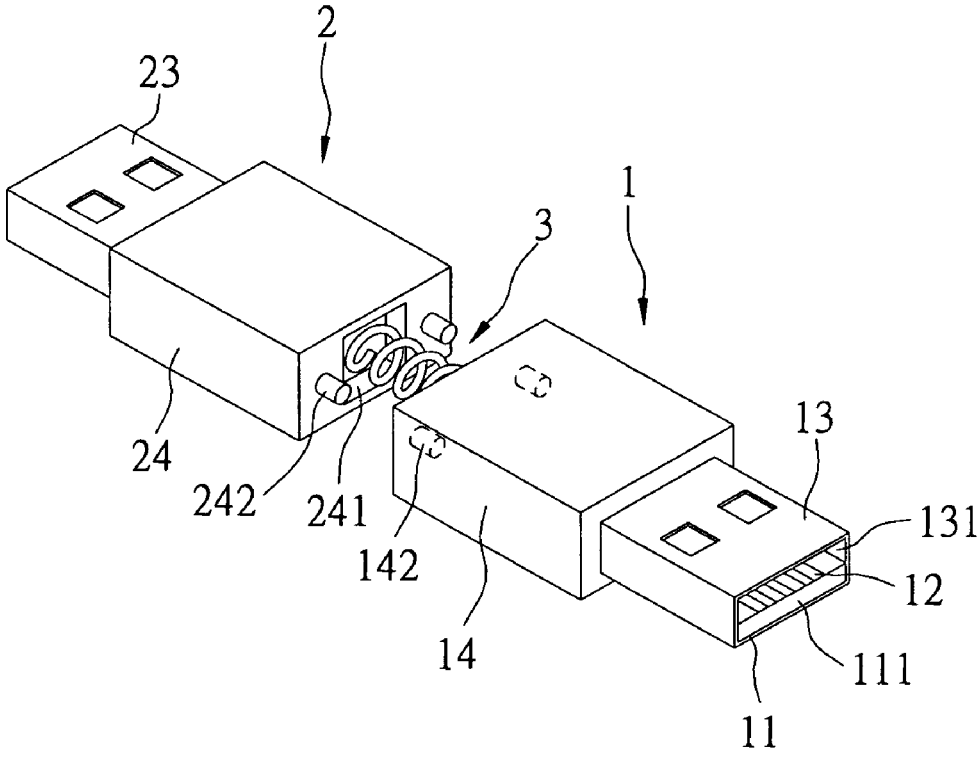
FIG. 3 illustrates a perspective view of an adjustable connection assembly according to the second embodiment of the present invention.

Reference is made to FIG. 3. According to the second embodiment of the present invention, a connection hole 142 and a connection pin 242 are positioned on the rear end of the first housing 14 of the first connector 1 and the second housing 24 of the second connector 2, respectively. The connection hole 142 corresponds to the connection pin 242 and is adapted to receive the connection pin 242. Besides, the connection hole 142 can be a curved hole, and the connection pin 142 can be a curved pin, as shown in FIG. 7. When the first connector 1 abuts against the second connector 2, the distance between the first connector 1 and the second connector 2 is minimal. The connection pin 242 is plugged into the connection hole 142 so that the first connector 1 is combined with the second connector 2. Besides, the signal cable 3 is received within the first recess 141 of the first housing 14 and the second recess 241 of the second housing 24.

Figure 4:
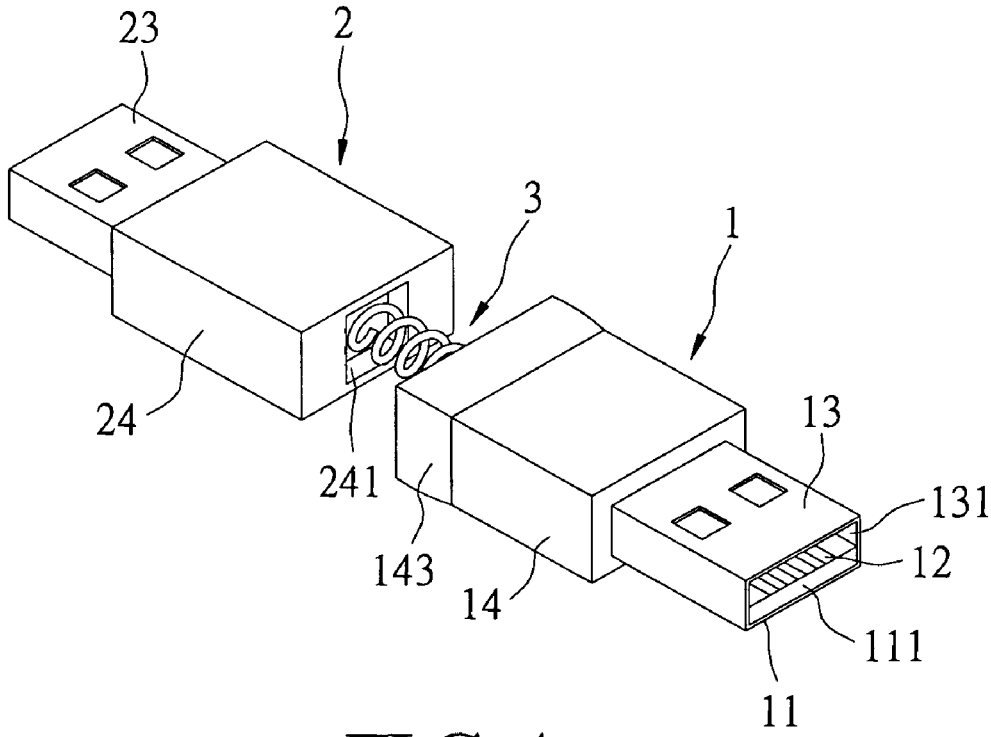
FIG. 4 illustrates a perspective view of an adjustable connection assembly according to the third embodiment of the present invention.

Reference is made to FIG. 4. According to the third embodiment of the present invention, an extension portion 143 extends from the rear end of the first housing 14 of the first connector 1 and is a hollow housing. When the first connector 1 is combined with the second connector 2, the distance between the first connector 1 and the second connector 2 is minimal. The extension portion 143 of the first connector 1 is used to cover outer surface of the rear end of the second connector 2. The rear end of the second connector 2 is plugged into the extension portion 143 of the first connector 1 so that the first connector 1 is combined with the second connector 2. Additionally, the signal cable is enclosed by the extension portion 143.

Figure 5:
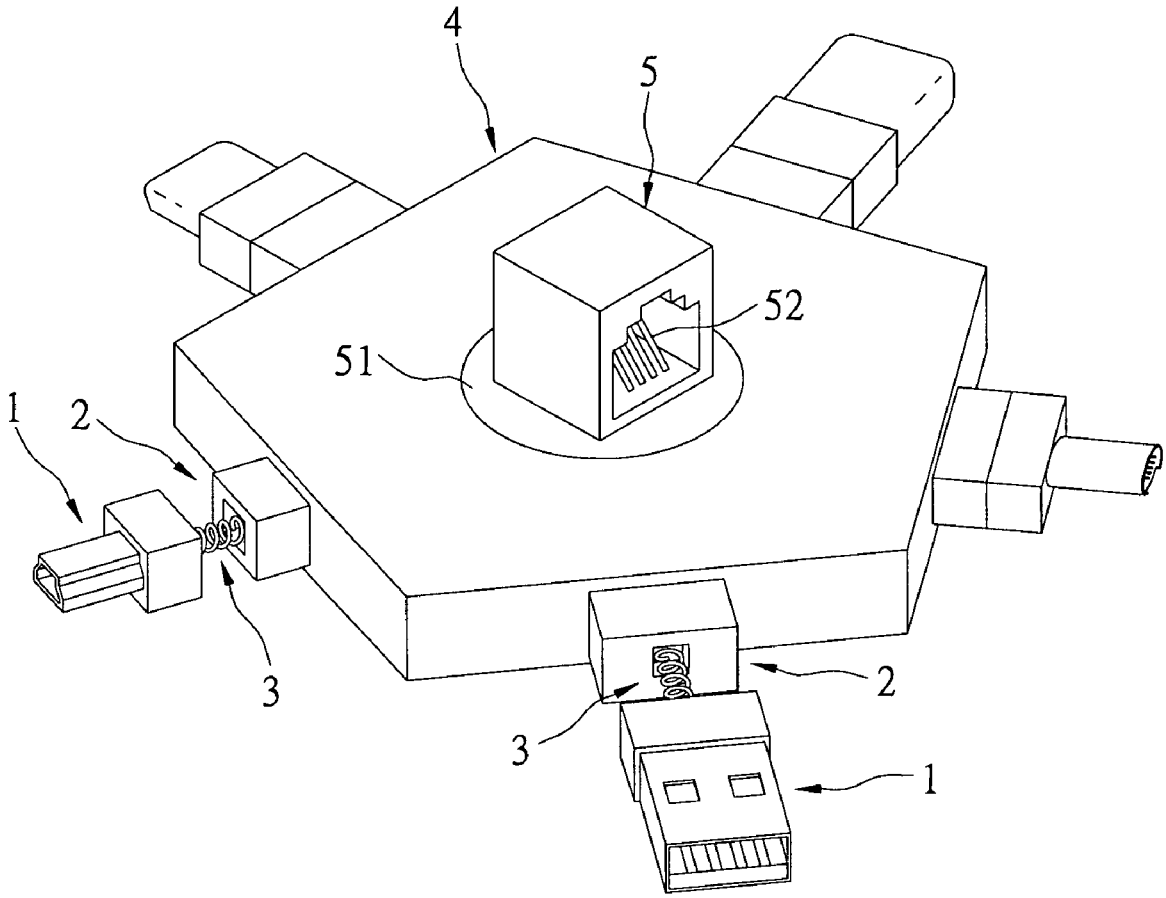
FIG. 5 illustrates a perspective view of an adjustable connection assembly according to the fourth embodiment of the present invention.

Reference is made to FIG. 5. According to the fourth embodiment of the present invention, the first connector 1 and the second connector 2 can be different types of connectors. Besides, the present invention is applicable to any rotatable multiple conversion device. The multiple conversion device includes a main body 4, and a third connector 5 is rotatably positioned at the main body 4. The third connector 5 can be a plug, socket or other electrical connector, and the third connector 5 can be positioned vertically or horizontally. According to the fourth embodiment of the present invention, the third connector 5 is a socket and positioned horizontally. A rotatable stand 51 is positioned at the bottom of the third connector 5 and rotatably positioned on the top surface of the main body 4. Thus, the third connector 5 is rotatable with respect to the main body 4 and includes a plurality of third terminals 52 made of metal. The second connector 2 (or the first connector 1) is snapped into or positioned at the main body 4, and is electrically connected with the third connector 5.

In practice, one connector at one end of a signal cable (not shown) is plugged into the third connector 5 of the multiple conversion device so that the signal cable is electrically connected with the multiple conversion device. Then, the first connector 1 (or the second connector 2) of the multiple conversion device is plugged into a connector of electronic device (not shown) so that the multiple conversion device is electrically connected with the electronic device by the signal cable.

The fourth embodiment includes different types of the first connector 1 and the second connector 2 that are electrically connected and have good adaptability. According to the fourth embodiment of the present invention, the third connector 5 is rotatable with respect to the first connector 1 and the second connector 2. Thus, when the multiple conversion device is in use, the signal cable does not interfere with the operation of the electronic device so that plugging in and unplugging signal cable is much more convenient.

Figure 6:
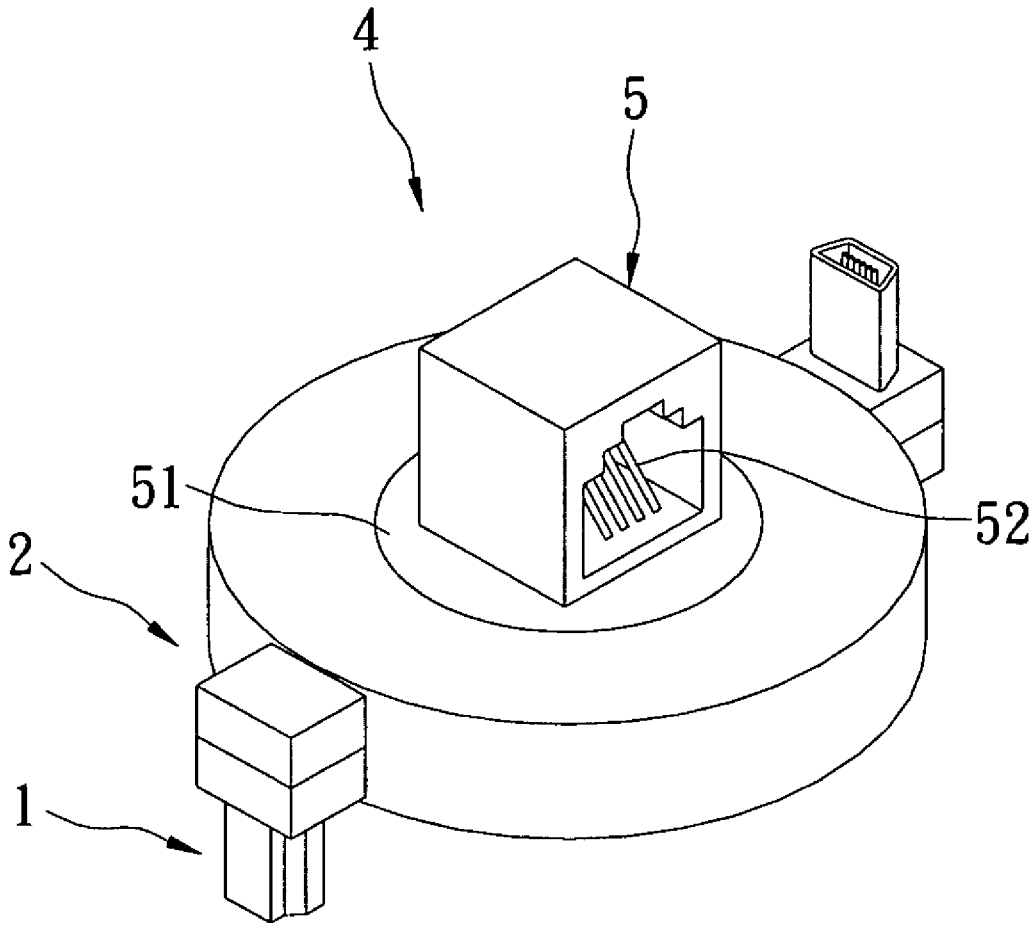
FIG. 6 illustrates a perspective view of an adjustable connection assembly according to the fifth embodiment of the present invention.

Reference is made to FIG. 6. According to the fifth embodiment of the present invention, the first connector 1 and the second connector 2 are positioned at 90 degrees to the main body 4. Thus, much footprint is conserved.

Figure 8:
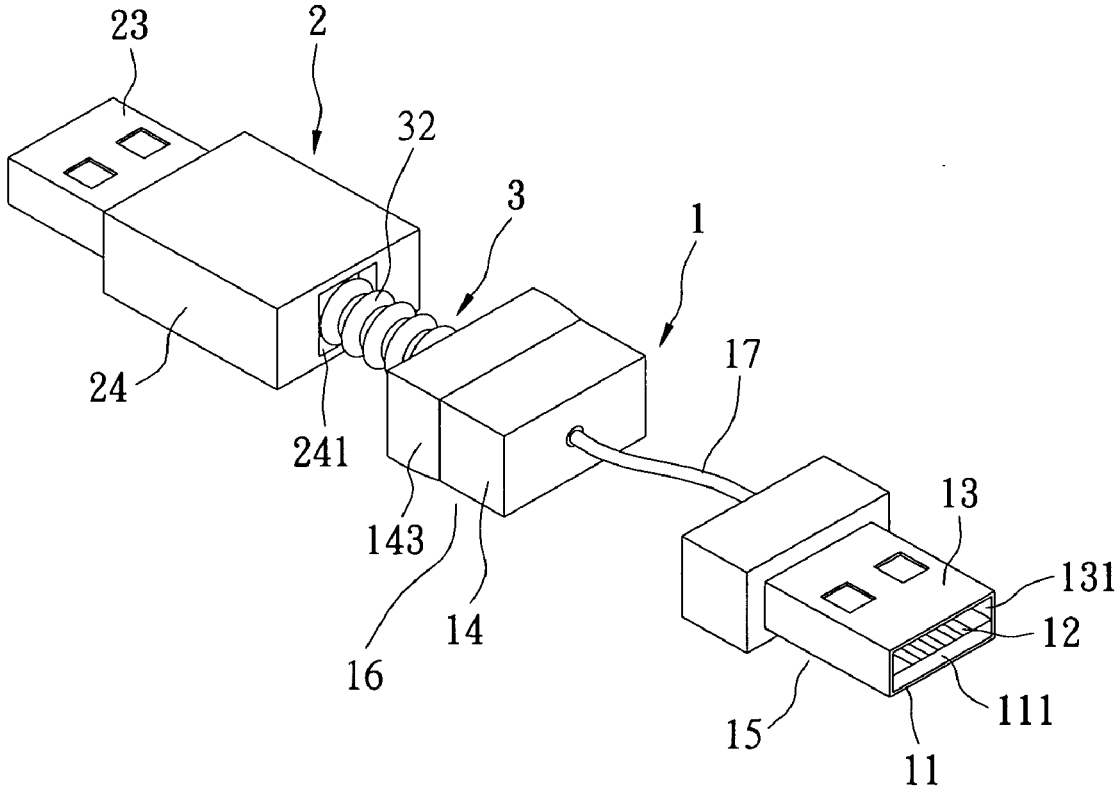
FIG. 8 illustrates a perspective view of an adjustable connection assembly according to the seventh embodiment of the present invention.

Reference is made to FIG. 8. According to the present invention, the signal cable 3 is received within and protected by a helical tube 32. Besides, the first connector 1 includes a front portion 15 and a rear portion 16 that are separate. Additionally, the front portion 15 is electrically connected with the rear portion 16 by a connection wire 17.

Figure 9:
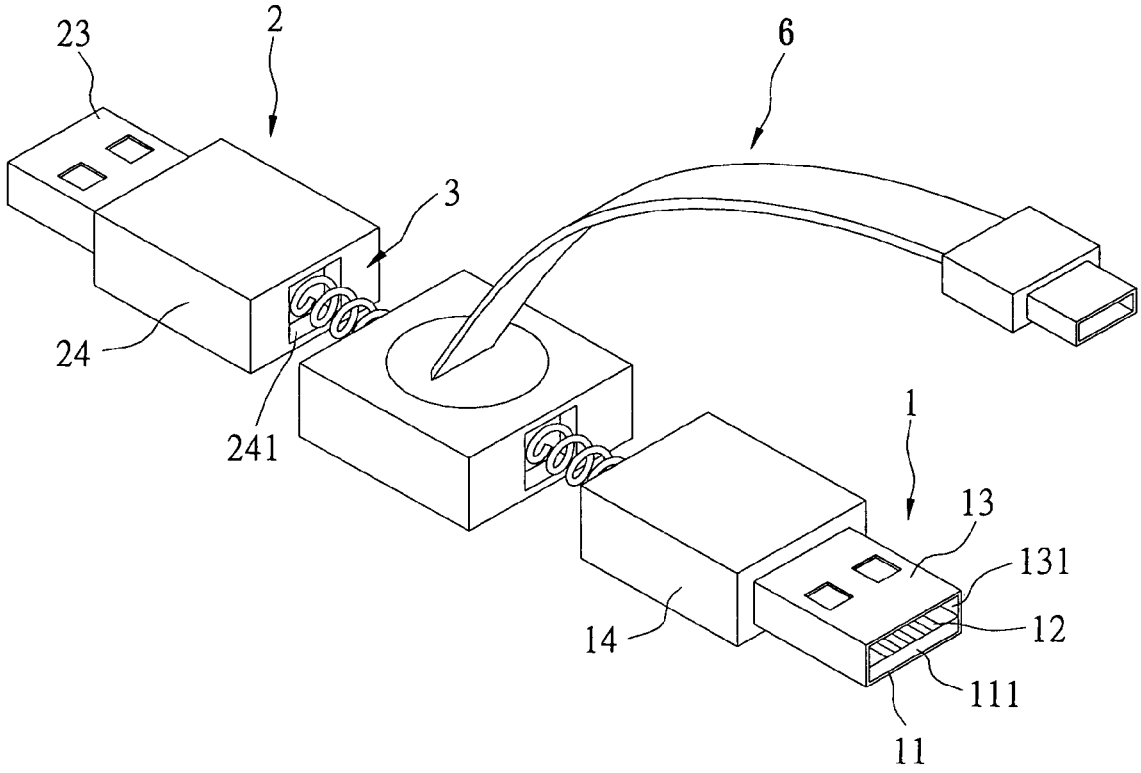
FIG. 9 illustrates a perspective view of an adjustable connection assembly according to the eighth embodiment of the present invention.

Reference is made to FIG. 9. According to the present invention, the signal cable can be electrically connected with a rotatable conversion device 6.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. An adjustable connection assembly, comprising:

a first connector including a first housing, a first shielding housing extending from a front end of the first housing, a first isolation main body extending from the first housing within the first shielding housing, and a plurality of first terminals positioned on the first isolation main body, the first housing having a first recess formed in a rear end thereof;

a second connector including a second housing, a second shielding housing extending from a front end of the second housing, a second isolation main body extending from the second housing within the second shielding housing, and a plurality of second terminals positioned on the second isolation main body, the second housing having a second recess formed in a rear end thereof, the second recess being disposed in aligned relationship with the first recess, the first and second recesses defining a cavity when the rear end of the first housing is positioned continuous the rear end of the second housing; and a signal cable extending between the first connector and the second connector and including a plurality of conductive wires respectively electrically connected with the first connector and the second connector, wherein the signal cable is helically-shaped, flexible and partially retractable into each of the first and second recesses, the signal cable being completely received within the cavity.

2. The adjustable connection assembly as claimed in claim 1, wherein the first isolation main body has a protruding portion and one end of each first terminal extends to the protruding portion of the first isolation main body, and the first shielding housing encloses the protruding portion of the first isolation main body and includes an opening defined by the protruding portion of the first isolation main body.

3. The adjustable connection assembly as claimed in claim 1, wherein the second isolation main body has a protruding portion and one end of each second terminal extends to the protruding portion of the second isolation main body, and the second shielding housing encloses the protruding portion of the second isolation main body and includes an opening defined by the protruding portion of the second isolation main body.

4. The adjustable connection assembly as claimed in claim 1, wherein a connection hole is formed in the rear end of the first housing of the first connector and a connection pin extends from a rear end of the second housing of the second connector in correspondence with the connection hole, wherein the connection pin is plugged into the connection hole when the rear end of first housing is positioned contiguous the rear end of the second housing.

5. The adjustable connection assembly as claimed in claim 1, wherein an extension portion extends from a rear end of the first housing of the first connector and is a hollow housing, and when the rear end of first housing is positioned contiguous the rear end of the second housing the extension portion of the first connector covers an outer surface of a rear end of the second connector.

6. The adjustable connection assembly as claimed in claim 1, further comprising a main body having a third connector rotatably positioned on the main body, the second connector being coupled to the main body and the third connector thereby being electrically connected with the first connector.

7. The adjustable connection assembly as claimed in claim 1, wherein the first connector includes a separate front portion and a separate rear portion, and the front portion is electrically connected with the rear portion by a connection wire.

* * * * *